US011384521B2

(12) United States Patent
Nakamura et al.

(10) Patent No.: US 11,384,521 B2
(45) **Date of Patent: *Jul. 12, 2022**

(54) FLUSH TOILET

(71) Applicant: TOTO LTD., Kitakyushu (JP)

(72) Inventors: Kenichi Nakamura, Fukuoka (JP); Hiroshi Hashimoto, Fukuoka (JP); Jing Chen, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/015,130

(22) Filed: Sep. 9, 2020

(65) Prior Publication Data

US 2021/0095453 A1 Apr. 1, 2021

(30) Foreign Application Priority Data

Sep. 30, 2019 (JP) ..... JP2019-180456

(51) Int. Cl.
*E03D 11/08* (2006.01)
*E03D 1/28* (2006.01)

(52) U.S. Cl.
CPC ..... *E03D 11/08* (2013.01); *E03D 1/28* (2013.01)

(58) Field of Classification Search
CPC ..... E03D 11/08
USPC ..... 4/329, 420
See application file for complete search history.

(56) References Cited

U.S. PATENT DOCUMENTS

2015/0082531 A1* 3/2015 Kashirajima ..... E03D 11/00 4/420
2016/0222641 A1 8/2016 Urata et al.

FOREIGN PATENT DOCUMENTS

| | | |
|---|---|---|
| CN | 105839752 | 8/2016 |
| EP | 3054061 | 8/2016 |
| EP | 3301234 | 4/2018 |
| JP | 5553188 | 7/2014 |
| JP | 2015-196960 | 11/2015 |
| JP | 2016-142100 | 8/2016 |
| JP | 2017-048599 | 3/2017 |
| JP | 2018-013037 | 1/2018 |
| JP | 2019-190217 | 10/2019 |
| JP | 2019-190219 | 10/2019 |

* cited by examiner

*Primary Examiner* — Lauren A Crane
(74) *Attorney, Agent, or Firm* — Amin, Turocy & Watson, LLP

(57) ABSTRACT

A flush toilet according to an embodiment includes a bowl part, a rim part, a water spout port, and a water storage part. The bowl part receives waste. The rim part is formed on a top of the bowl part. The water spout port spouts a washing water. The water storage part is formed on a bottom of the bowl part. A first region that is connected to a discharge channel and a second region that is located on a front side of the first region are formed in the water storage part. A main stream of the washing water that is spouted from the water spout port along the rim part swirls on the bowl part and flows into the first region.

4 Claims, 5 Drawing Sheets

FLUSH TOILET

CROSS-REFERENCE TO RELATED APPLICATION(S)

The present application claims priority to and incorporates by reference the entire contents of Japanese Patent Application No. 2019-180456 filed in Japan on Sep. 30, 2019.

FIELD

A disclosed embodiment(s) relate(s) to a flush toilet.

BACKGROUND

A flush toilet has conventionally been known that causes a main stream of a washing water that swirls along a rim part to flow into a water storage part from a front side of a bowl part (see, for example, Japanese Patent No. 5553188).

However, in a flush toilet as described above, as a length of a bowl part in frontward and backward directions is decreased for downsizing of the flush toilet, a flow rate of a washing water may increase, so that it may not flow into a water storage part from a front side of the bowl part and a discharging performance for waste may be degraded.

SUMMARY

A flush toilet according to an embodiment includes a bowl part, a rim part, a water spout port, and a water storage part. The bowl part receives waste. The rim part is formed on a top of the bowl part. The water spout port spouts a washing water. The water storage part is formed on a bottom of the bowl part. A first region that is connected to a discharge channel and a second region that is located on a front side of the first region are formed in the water storage part. A main stream of the washing water that is spouted from the water spout port along the rim part swirls on the bowl part and flows into the first region.

The above and other objects, features, advantages and technical and industrial significance of this invention will be better understood by reading the following detailed description of presently preferred embodiments of the invention, when considered in connection with the accompanying drawings.

DESCRIPTION OF EMBODIMENT(S)

Figure 1:
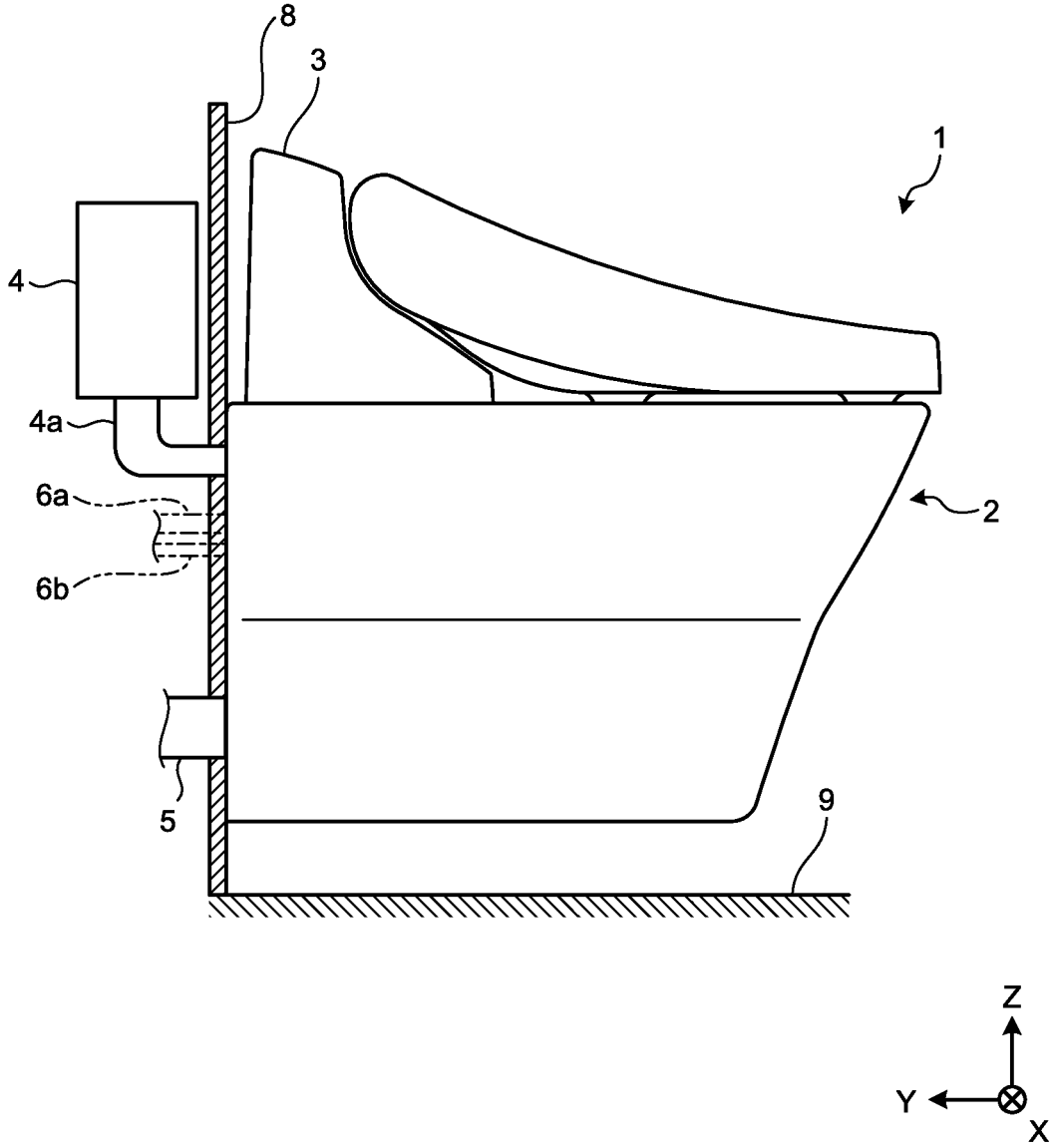
FIG. 1 is a left side view of a flush toilet according to an embodiment.

Hereinafter, an embodiment(s) of a flush toilet as disclosed in the present application will be explained in detail with reference to the accompanying drawing(s). Additionally, this invention is not limited by an embodiment(s) as illustrated below. Furthermore, it has to be noted that the drawing(s) is/are schematic, so that a relationship(s) among dimensions of respective elements, a ratio(s) of respective elements, or the like may be different from a reality. Among mutual drawings, parts with different relationships of mutual dimensions or ratios may also be included therein.

General Configuration of Flush Toilet

First, a general configuration of a flush toilet 1 according to an embodiment will be explained with reference to FIG. 1. FIG. 1 is a left side view of the flush toilet 1 according to an embodiment. Furthermore, FIG. 1 illustrates a wall surface 8 and a floor surface 9 in a cross section.

Furthermore, FIG. 1 illustrates a three-dimensional orthogonal coordinate system that includes a Z-axis where a vertically upward direction is a positive direction, for providing a comprehensible explanation. Such an orthogonal coordinate system may also be illustrated in another figure. In such an orthogonal coordinate system, a negative direction of a Y-axis, a positive direction of the Y-axis, a positive direction of an X-axis, and a negative direction of the X-axis are defined as a front side, a back side, a right side, and a left side, respectively. Hence, in a following explanation, X-axis directions, Y-axis directions, and Z-axis directions may be leftward and rightward directions, frontward and backward directions, and upward and downward directions, respectively.

Furthermore, the flush toilet 1 according to an embodiment is a so-called wall-hung type flush toilet that is attached to the wall surface 8. Additionally, a flush toilet may be a so-called floor-mounted type flush toilet that is placed on the floor surface 9.

The flush toilet 1 includes a toilet body 2 and a private part washing device 3. The flush toilet 1 according to an embodiment is a wash-down type toilet (a washdown type toilet) that washes the toilet body 2 with a washing water that is supplied from a washing water source, and discharges waste. Furthermore, the toilet body 2 is made of, for example, a ceramic. A detail of the toilet body 2 will be described later.

The private part washing device 3 includes a washing nozzle, a motor for driving a nozzle, a motor control device (where none of them is illustrated), and the like. The private part washing device 3 is provided on a top of the toilet body 2, for washing a private part of a user, and washes a private part of a user with a washing water that is jetted from a washing nozzle.

For the flush toilet 1, a washing water is supplied to the toilet body 2 through a water supply pipe 4*a* that is connected to a water storage tank 4.

Furthermore, the flush toilet 1 discharges waste, together with a washing water, to a water discharge pipe 5.

Additionally, the water storage tank 4 may be mounted on a back side of the toilet body 2 and directly supply a washing water from the water storage tank 4 to the toilet body 2.

Furthermore, the flush toilet 1 includes a water supply hose 6*a* for supplying a washing water for washing a private part to the private part washing device 3 and an electric power source cable 6*b* for supplying electric power to the private part washing device 3.

Toilet Body

Figure 2:
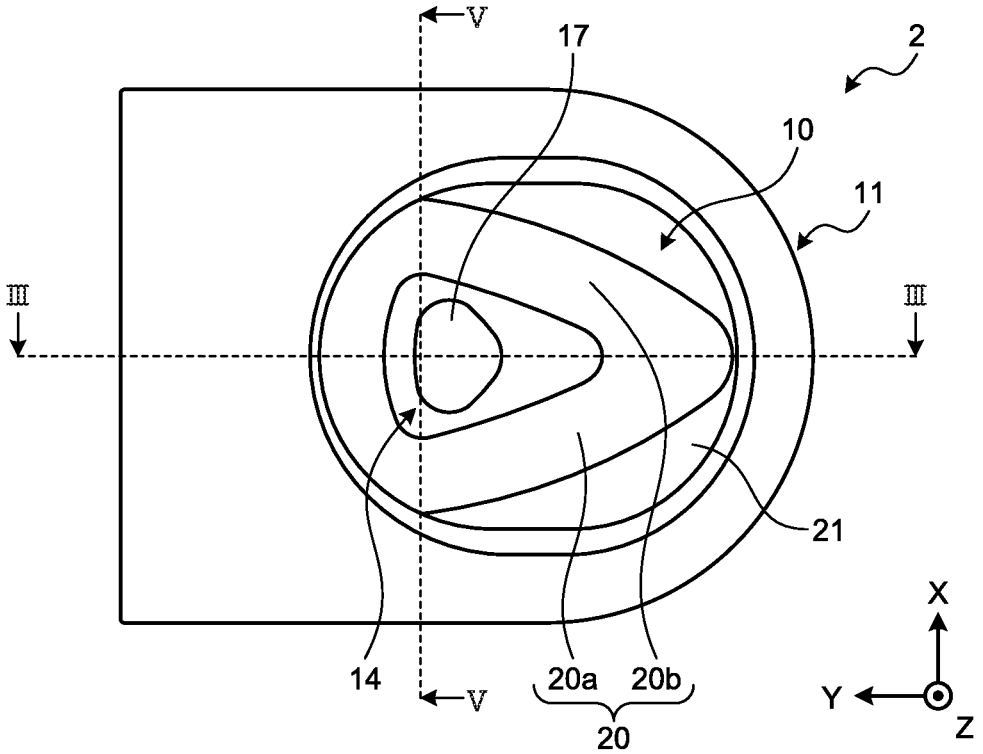
FIG. 2 is a plan view of a toilet body according to an embodiment.
Figure 3:
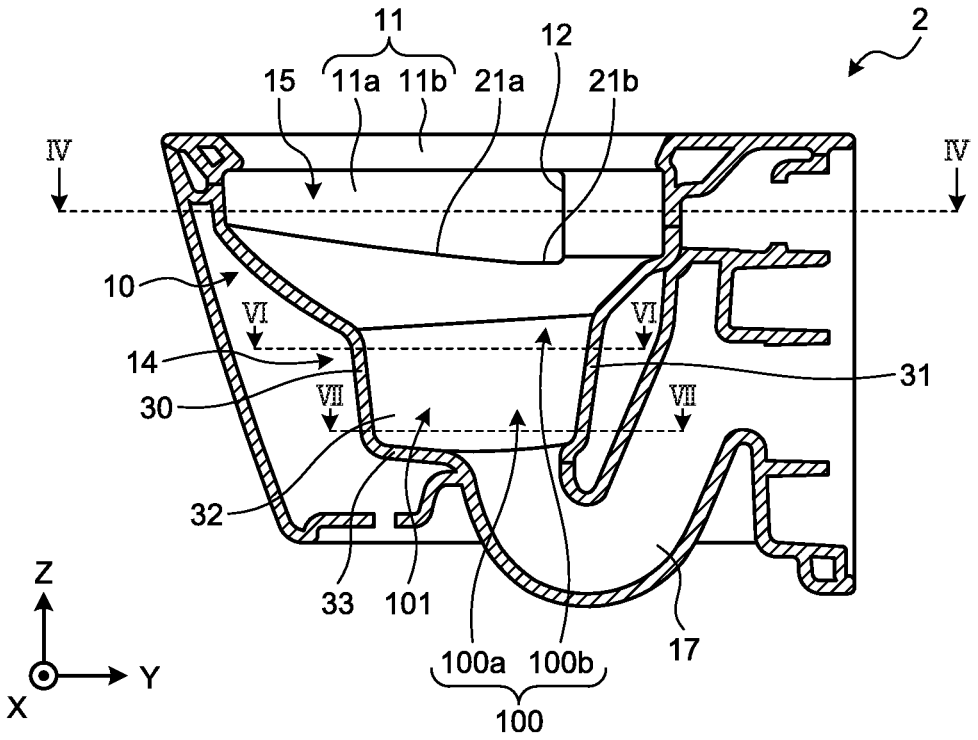
FIG. 3 is a III-III cross-sectional view of FIG. 2.
Figure 4:
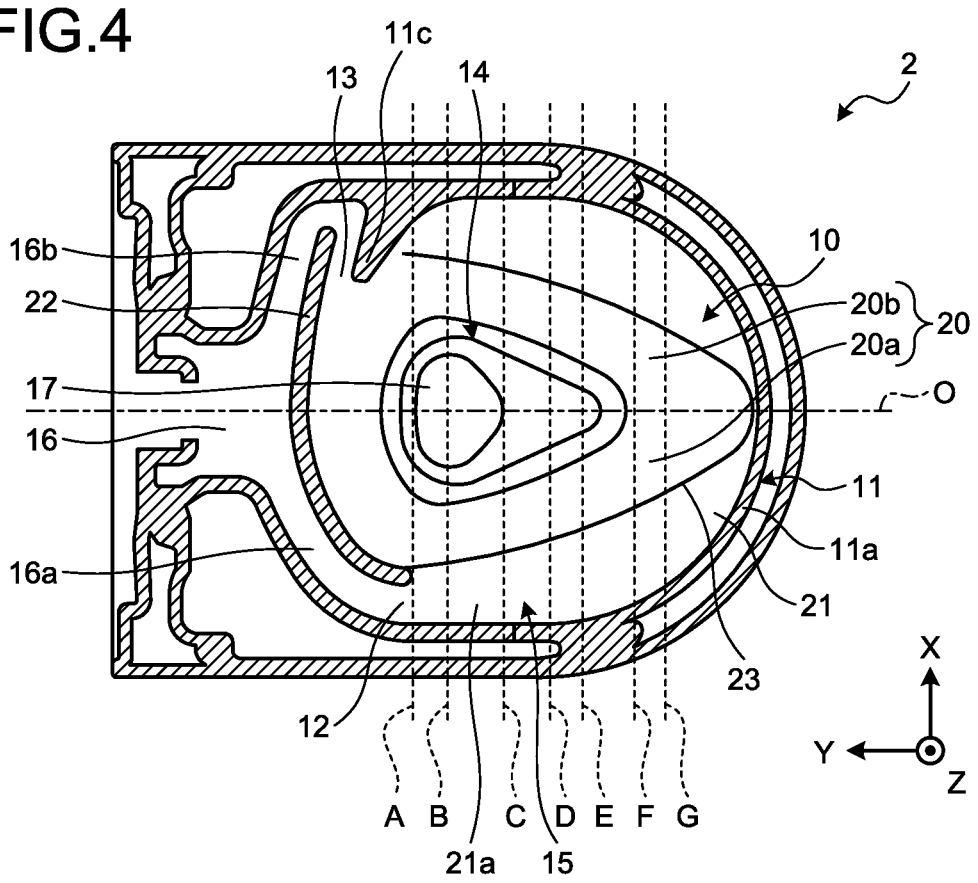
FIG. 4 is a cross-sectional view of a toilet body in a IV-IV cross section of FIG. 3.
Figure 5:
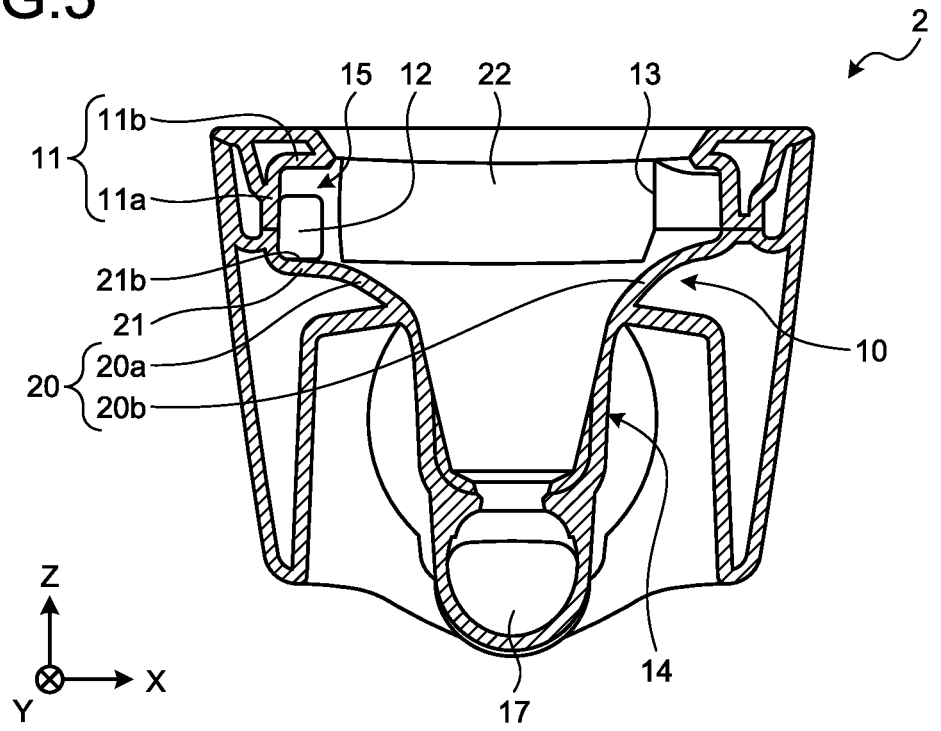
FIG. 5 is a V-V cross-sectional view of FIG. 2.

Next, the toilet body 2 according to an embodiment will be explained with reference to FIG. 2 to FIG. 5. FIG. 2 is a plan view of the toilet body 2 according to an embodiment. FIG. 3 is a III-III cross-sectional view of FIG. 2. FIG. 4 is a cross-sectional view of the toilet body 2 in a IV-IV cross section of FIG. 3. FIG. 5 is a V-V cross-sectional view of FIG. 2.

The toilet body 2 includes a bowl part 10, a rim part 11, a first water spout port 12 (a water spout port), a second water spout port 13 (a water spout port), and a water storage part 14. The toilet body 2 spouts a washing water from each of the first water spout port 12 that is formed on a left side and the second water spout port 13 that is formed on a right side so as to discharge waste. Hereinafter, a washing water that is spouted from the first water spout port 12 may be referred to as a "first washing water" and a washing water that is spouted from the second water spout port 13 may be referred to as a "second washing water".

The bowl part 10 is formed into a bowl shape and receives waste. The bowl part 10 includes a first guide part 20 and a second guide part 21 (a swirl part). Details of the first guide part 20 and the second guide part 21 will be described later.

The rim part 11 is provided on a top of the bowl part 10. The rim part 11 includes a side wall part 11*a* that extends upward from an upper end of the bowl part 10 and an upper wall part 11*b* that extends from an upper end of the side wall part 11*a* to an inside of the bowl part 10. The side wall part 11*a* and the upper wall part 11*b* are formed along a periphery of the bowl part 10. The rim part 11 is formed into an overhung shape in such a manner that a first washing water does not jump out therefrom.

In the toilet body 2, a passing water channel 15 where a main stream of a first washing water that is spouted from the first water spout port 12 flows is formed by the rim part 11 and the bowl part 10. Specifically, the passing water channel 15 is formed by the side wall part 11*a* and the upper wall part 11*b* of the rim part 11 and a part of the second guide part 21 of the bowl part 10 (that will be referred to as a "bottom surface wall 21*a*" below). Additionally, the bottom surface wall 21*a* of the passing water channel 15 may be formed by the rim part 11. The passing water channel 15 is formed so as to cause a main stream of a first washing water that is spouted from the first water spout port 12 to swirl to a back side of the bowl part 10.

In the present specification, a main stream is a flow with a great force of water in the bowl part 10, in a washing water that is spouted from a water spout port to the bowl part 10. Furthermore, a great force of water refers to a greater magnitude of an amount of flow or a flow rate in the bowl part 10.

The passing water channel 15 is formed so as to be an upward slope from a side of the first water spout port 12 toward a front end of the bowl part 10.

Specifically, on the passing water channel 15, the bottom surface wall 21*a* is formed in such a manner that a height thereof increases from a side of the first water spout port 12 toward a front end of the bowl part 10. The bottom surface wall 21*a* is formed in such a manner that a height thereof continuously increases from a side of the first water spout port 12 toward a front end of the bowl part 10. Furthermore, a configuration is provided in such a manner that a length of the side wall part 11*a* in upward and downward directions decreases toward a front end of the bowl part 10.

An end part of the bottom surface wall 21*a* on a side of the first water spout port 12 is provided below the first water spout port 12. An end part of the bottom surface wall 21*a* extends a water spout region where a first washing water is spouted. Hereinafter, an end part of the bottom surface wall 21*a* that is located below the first water spout port 12 may be referred to as a "region extension part 21*b* (an extension part)".

Furthermore, the region extension part 21*b* is formed in such a manner that a side of the water storage part 14 is lower than a side of the rim part 11, specifically, a side of the side wall part 11*a* of the rim part 11.

Furthermore, a protrusion part 11*c* is formed on the rim part 11 on a front side of the second water sport port 13. The protrusion part 11*c* protrudes toward an inside of the bowl part 10 so as to block the passing water channel 15. The protrusion part 11*c* changes a direction of a main stream of a first washing water and causes the main stream of a first washing water to flow into the water storage part 14.

The first water spout port 12 is formed on a top of the bowl part 10 on a left back side. The first water spout port 12 spouts, along the rim part 11, a first washing water that is supplied through a first water transmission channel 16*a* that branches from a common water transmission channel 16. The common water transmission channel 16 is connected to the water supply pipe 4*a* (see FIG. 1) and a washing water is supplied through the water supply pipe 4*a*. The first water spout port 12 spouts a first washing water along the rim part 11 from a back side toward a front side.

The second water spout port 13 is formed on a top of the bowl part 10 on a right back side. The second water spout port 13 spouts, to the bowl part 10, a second washing water that is supplied through a second water transmission channel 16*b* that branches from the common water transmission channel 16.

The second water spout port 13 spouts a second washing water along a back wall part 22 that is formed on a back end of the bowl part 10. The second water spout port 13 spouts a washing water from a right side toward a left side. The back wall part 22 is formed so as to be recessed on a back side and causes a second washing water that is spouted from the second water spout port 13 to swirl.

Water Storage Part

Figure 6:
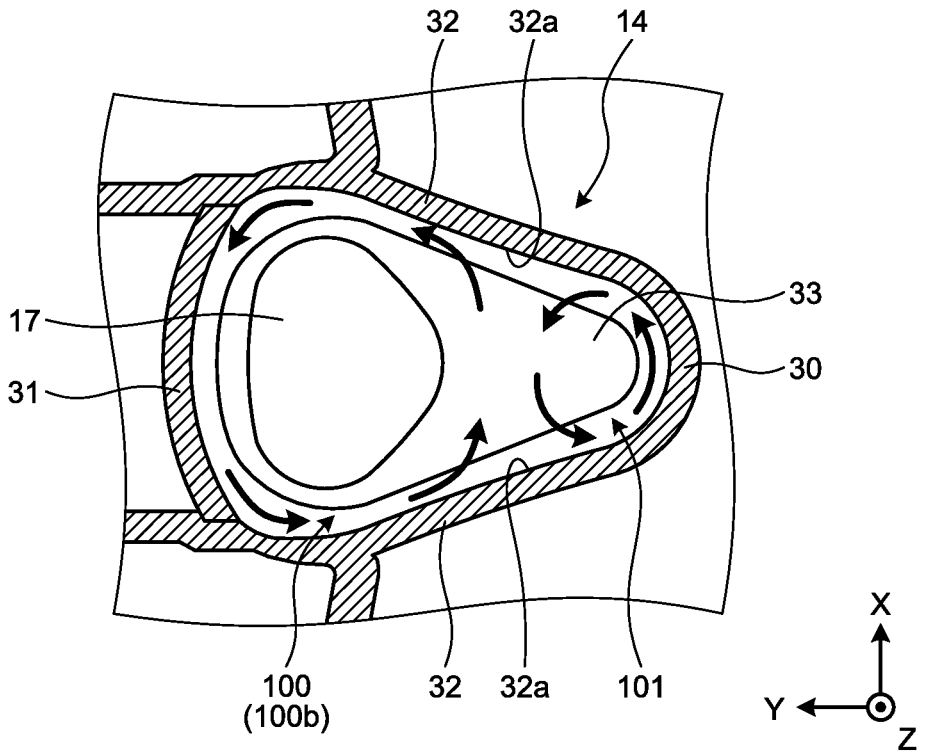
FIG. 6 is a cross-sectional view of a water storage part in a VI-VI cross section of FIG. 3.
Figure 7:
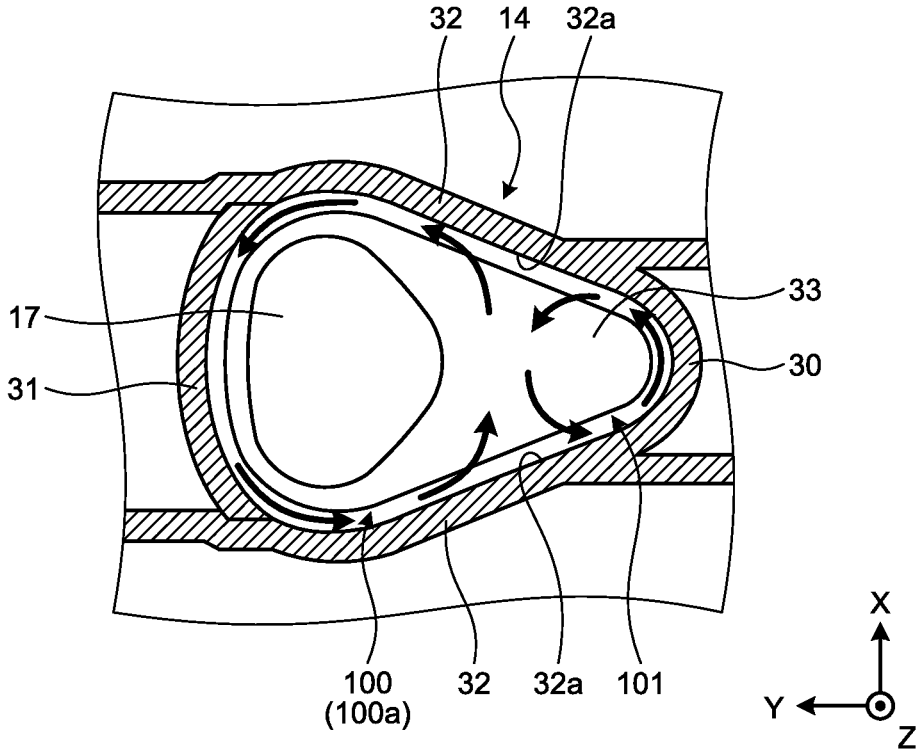
FIG. 7 is a cross-sectional view of a water storage part in a VII-VII cross section of FIG. 3.

Next, the water storage part 14 will be explained with reference to FIG. 3, FIG. 6, and FIG. 7. FIG. 6 is a cross-sectional view of the water storage part 14 in a VI-VI cross section of FIG. 3. FIG. 7 is a cross-sectional view of the water storage part 14 in a VII-VII cross section of FIG. 3.

The water storage part 14 is provided below the bowl part 10. The water storage part 14 stores a part of a washing water as a stored water. The water storage part 14 is connected to a discharge channel 17 and discharges waste, together with a washing water, to the discharge channel 17. The discharge channel 17 is connected to the water discharge pipe 5 (see FIG. 1). The water storage part 14 is formed in such a manner that a height of a front end thereof is minimum.

The water storage part 14 includes a front surface part 30, a back surface part 31, a pair of side surface parts 32, and a bottom surface part 33. The front surface part 30 is formed so as to protrude frontward and be curved. Furthermore, the back surface part 31 is formed so as to protrude backward and be curved. Furthermore, the bottom surface part 33 is connected to the discharge channel 17.

The pair of side surface parts 32 is formed so as to broaden from a front side to a back side in such a manner that a distance between back ends thereof is greater than a distance between front ends thereof. That is, the water storage part 14 is formed in such a manner that a back side is larger than a front side in a plan view.

For the pair of side surface parts 32, a convex surface 32*a* is formed that protrudes toward an opposed side surface part 32. The convex surface 32*a* is formed so as to be curved in such a manner that a side surface part 32 generally protrudes toward another side surface part 32. Additionally, the convex surface 32*a* may be formed so as to be curved in such a manner that a part of a side surface part 32 protrudes toward another side surface part 32. The convex surface 32*a* is formed along upward and downward directions. A lower end of the convex surface 32*a* is located above the bottom surface part 33. That is, the convex surface 32*a* is not connected to the bottom surface part 33 and a gap is formed between the convex surface 32*a* and the bottom surface part 33. Additionally, a lower end of the convex surface 32*a* may be formed to the bottom surface part 33.

Additionally, the front surface part 30 and the pair of side surface parts 32 are connected by a curved surface. Furthermore, the back surface part 31 and the pair of side surface parts 32 are connected by a curved surface.

In the water storage part 14, a first region 100 that is a region on a top of the discharge channel 17 and a second region 101 that is a region on a front side of the first region 100 are formed. Partition into the first region 100 and the second region 101 is provided by a vertex of the convex surface 32*a* in a plan view. The water storage part 14 on a back side of a vertex of the convex surface 32*a* is the first region 100 and the water storage part 14 on a front side of the vertex of the convex surface 32*a* is the second region 101. The convex surface 32*a* is formed over the first region 100 and the second region 101.

In the first region 100, a lower region 100*a* that is provided on a side of the discharge channel 17 and an upper region 100*b* above the lower region 100*a* are formed. The water storage part 14 is formed in such a manner that a change of a flow rate of a swirling flow in the upper region 100*b* is greater than that in the lower region 100*a*. Specifically, a curvature of a curved surface that forms the upper region 100*b* is greater than a curvature of a curved surface that forms the lower region 100*a*.

For example, for a curved surface that connects the back surface part 31 and the side surface part 32, a curvature of a curved surface that forms the upper region 100*b* is greater than a curvature of a curved surface that forms the lower region 100*a*. Additionally, a curvature of the back surface part 31 that forms the upper region 100*b* may be greater than a curvature of the back surface part 31 that forms the lower region 100*a*.

Additionally, a region that transits from the upper region 100*b* to the lower region 100*a* is formed in such a manner that a curvature of a curved surface is changed continuously.

Furthermore, the first region 100 is formed in such a manner that a swirling flow that has a swirl radius that is greater than that in the second region 101 is generated. Specifically, a cross-sectional area of the first region 100 in a horizontal direction is greater than a cross-sectional area of the second region 101 in a horizontal direction.

Furthermore, the first region 100 and the second region 101 are formed in such a manner that swirling flows with different flow rates are generated in the upper region 100*b* and the second region 101. Specifically, a curvature of a curved surface that forms the upper region 100*b* is different from a curvature of a curved surface that forms the second region 101. For example, a curvature of the back surface part 31 that forms the upper region 100*b* is different from a curvature of the front surface part 30 that forms the second region 101. Furthermore, a curvature of a curved surface that connects the back surface part 31 that forms the upper region 100*b* and the side surface part 32 is different from a curvature of the front surface part 30 that forms the second region 101.

Furthermore, the first region 100 and the second region 101 are formed in such a manner that a swirling flow with a flow rate that is less than that in the second region 101 is generated in the lower region 100*a*. Specifically, a curvature of a curved surface that forms the lower region 100*a* is less than a curvature of a curved surface that forms the second region 101. For example, a curvature of the back surface part 31 that forms the lower region 100*a* is less than a curvature of the front surface part 30 that forms the second region 101.

First Guide Part and Second Guide Part

Figure 8:
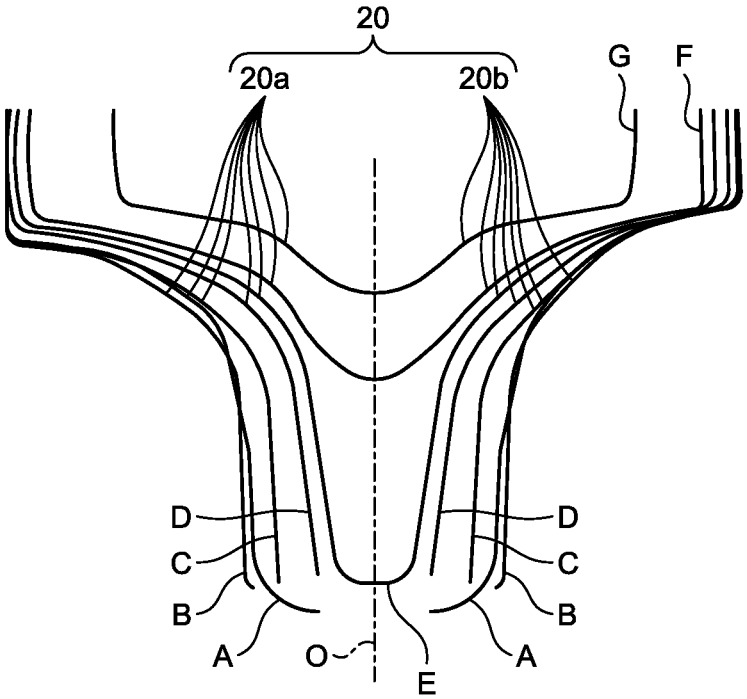
FIG. 8 is a diagram where surface shapes of a first guide part and a second guide part in cross sections as indicated by A to G in FIG. 4 are overlapped.

Next, the first guide part 20 and the second guide part 21 will be explained with reference to FIG. 3, FIG. 4, and FIG. 8. FIG. 8 is a diagram where surface shapes of the first guide part 20 and the second guide part 21 in cross sections as indicated by A to G in FIG. 4 are overlapped. A to G in FIG. 8 correspond to surface shapes of the first guide part 20 and the second guide part 21 in cross sections as indicated by A to G in FIG. 4.

The first guide part 20 is formed on a top of the water storage part 14. The second guide part 21 is formed on a top of the first guide part 20. The second guide part 21 is formed between the first guide part 20 and the rim part 11. The first guide part 20 and the second guide part 21 are connected by a ridge line part 23 that is formed of a curved surface. Furthermore, the ridge line part 23 is a vertex of a curved surface that connects the first guide part 20 and the second guide part 21.

The first guide part 20 is formed so as to broaden from a front side toward a back side of the bowl part 10. Specifically, the first guide part 20 is formed in such a manner that an upper end of the first guide part 20 is located outward in leftward and rightward directions from a front side toward a back side of the bowl part 10. That is, the ridge line part 23 is formed so as to broaden from a front side toward a back side of the bowl part 10. In other words, a distance of the ridge line part 23 from a center line O of the bowl part 10 in leftward and rightward directions increases from a front side toward a back side.

Furthermore, for the first guide part 20, a length from an upper end of the water storage part 14 to an upper end of the first guide part 20 increases toward a front side of the bowl part 10. Specifically, for the first guide part, a length of a surface from an upper end of the water storage part 14 to an upper end of the first guide part 20 increases toward a front side of the bowl part 10.

The first guide part 20 is asymmetric with respect to the center line O of the bowl part 10 in leftward and rightward directions. Hereinafter, an explanation may be provided in such a manner that the first guide part 20 on a left side with respect to the center line O is provided as a "first guide part 20*a*" and the first guide part 20 on a right side with respect to a center line of the bowl part 10 in leftward and rightward directions is provided as a "first guide part 20*b*". That is, an explanation may be provided in such a manner that the first guide part 20 on a side of the first water spout port 12 is provided as a "first guide part 20*a*" and the first guide part 20 on a side of the second water spout port 13 is provided as a "first guide part 20*b*".

The first guide part 20*a* is formed from a back side of the first water spout port 12 to a front end of the bowl part 10. The first guide part 20 is formed so as to cause a first washing water and a second washing water that flow downward from the region extension part 21*b* to flow into the first region 100.

The first guide part 20*a* is formed in such a manner that a slope thereof increases from a back side toward a front side. Specifically, the first guide part 20*a* is formed in such a manner that a slope thereof increases from a back side toward a front side in frontward and backward directions, from a vicinity of the first water spout port 12 to a vicinity of the second region 101 of the water storage part 14, as indicated by A to C in FIG. 4 and FIG. 8. Additionally, the first guide part 20*a* may be formed in such a manner that a slope thereof increases from a back side toward a front side, from a vicinity of the first water spout port 12 to a vicinity of a front end of the second region 101. A slope is an angle with respect to the floor surface 9 (see FIG. 1). Hence, a slope increases as perpendicularity of the first guide part 20 is increased.

Furthermore, the first guide part 20*a* is formed in such a manner that a slope thereof deceases from a vicinity of a front end of the water storage part 14 toward a front side.

The first guide part 20*b* is formed from a lower side of the protrusion part 11*c* to a front end of the bowl part 10. The first guide part 20*b* is formed in such a manner that a first washing water that flows into the first guide part 20 on a front side of the water storage part 14 (that includes the first guide part 20*a* and the first guide part 20*b*) swirls to the first region 100 and flows into the first region 100.

Furthermore, the first guide part 20 is provided so as to suppress flowing of a first washing water that flows into the first guide part 20 on a front side of the water storage part 14 into the second guide part 21 above the first guide part 20*b* by the ridge line part 23.

Furthermore, the first guide part 20*b* is formed in such a manner that a slope thereof increases from a front side to a back side as indicated by A to G in FIG. 4 and FIG. 8. That is, a slope of the first guide part 20*b* on a front side is small.

Furthermore, the first guide part 20 on a front side of the water storage part 14 is formed in such a manner that a curvature of a curved surface that forms the first guide part 20, specifically, a curved surface that forms a bottom part of the first guide part 20, increases from a front side toward a back side, as indicated by F to G in FIG. 4 and FIG. 8.

A slope of the second guide part 21 is less than that of the first guide part 20. The second guide part 21 suppresses flowing of a first washing water that deviates from the passing water channel 15, on the passing water channel 15 on a front side of the region extension part 21*b*.

The ridge line part 23 on a right side terminates on a back side of a middle point of the water storage part 14 in frontward and backward directions. Furthermore, the ridge line part 23 on a left side has a beginning on a back side of the first water spout port 12. A curvature of the ridge line part 23 increases from a front side toward a back side.

Flow of Washing Water

Figure 9:
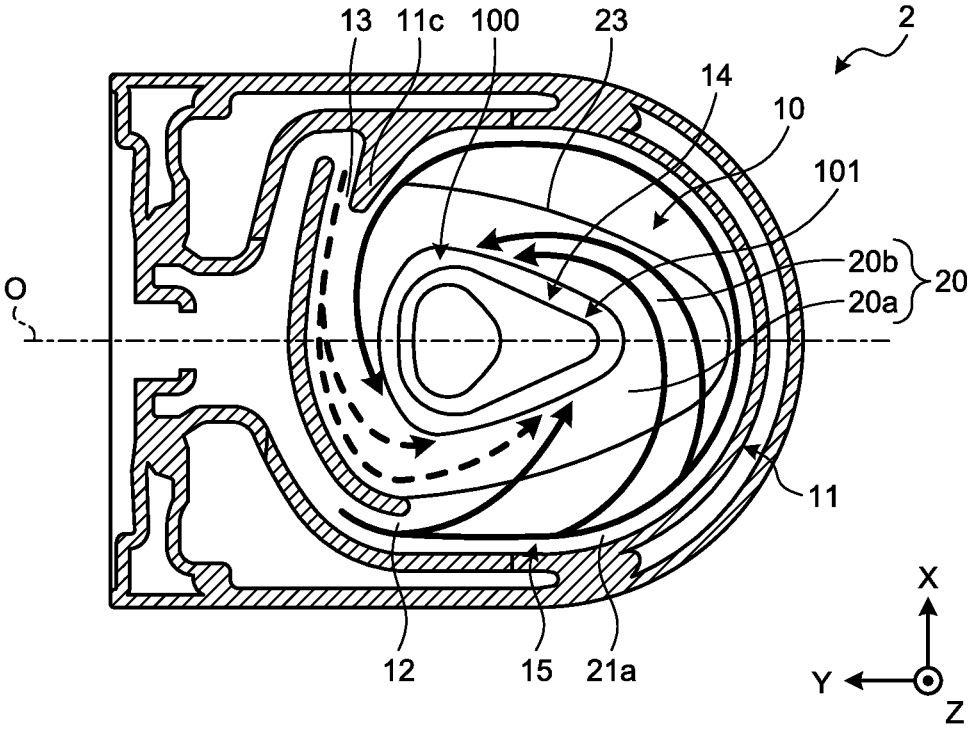
FIG. 9 is a diagram that explains flows of a first washing water and a second washing water on a bowl part.

Next, a flow of a washing water in the bowl part 10 will be explained with reference to FIG. 9. FIG. 9 is a diagram that explains flows of a first washing water and a second washing water in the bowl part 10. In FIG. 9, a flow of a first washing water is indicated by a solid line(s) and a flow of a second washing water is indicated by a broken line(s). Additionally, a washing water as illustrated in FIG. 9 is different from a washing water that simply flows down in the bowl part 10, and has a certain level of a force of water.

A main stream of a first washing water that is spouted from the first water spout port 12 swirls on the passing water channel 15. Specifically, a main stream of a first washing water passes through the passing water channel 15 from the first water spout port 12 and flows towards a front side, and a direction thereof is changed to a back side at a front end of the passing water channel 15 or on a front side of the water storage part 14. A direction of a main stream of a first washing water that flows toward a back side is changed by the protrusion part 11*c* and it flows into the first region 100 of the water storage part 14. Specifically, a main stream of a first washing water flows from a back side and a left side into the first region 100.

The passing water channel 15 is formed in such a manner that a height of the bottom surface wall 21*a* increases from the first water spout port 12 toward a front end of the bowl part 10. Hence, a kinetic energy that is possessed by a main stream of a first washing water is decreased, so that a swirl force of the main stream of a first washing water is adjusted and excessive swirling of the main stream of a first washing water is suppressed. Thereby, landing of a first washing water onto the rim part 11 or overflowing thereof is suppressed.

Furthermore, a part of a first washing water branches from the region extension part 21*b* and flows into the first guide part 20*a* immediately after being spouted from the first water spout port 12, and flows into the second region 101 along the first guide part 20*a*. A slope of the first guide part 20*a* increases toward a front side. Hence, a branched first washing water does not flow into the first guide part 20 on a front side of the water storage part 14 but flows into the second region 101 from a left side.

Furthermore, the passing water channel 15 is formed so as to be an upward slope, so that a part of a first washing water deviates from a main stream of a first washing water to the second guide part 21 in a middle of flowing through the passing water channel 15 on a front side of the region extension part 21*b*. Such a first washing water that deviates to the second guide part 21 flows into the first guide part 20 on a front side of the water storage part 14.

The first guide part 20 on a front side of the water storage part 14 is formed in such a manner that a curvature of a curved surface that forms the first guide part 20 increases from a front side toward a back side. Hence, in a first washing water that flows into the first guide part 20 on a front side of the water storage part 14, a direction of a flow of a first washing water that flows into a side of the water storage part 14 is rapidly changed by the first guide part 20 with a large curvature, so that it swirls backward along the first guide part 20*b*. Therefore, in a first washing water that flows into the first guide part 20 on a front side of the water storage part 14, flowing of a first washing water that flows into a side of the water storage part 14 into the second region 101 is suppressed, so that it swirls along the first guide part 20 and flows into the first region 100 from a right side.

Furthermore, in a first washing water that flows into the first guide part 20 on a front side of the water storage part 14, a first washing water that flows into a front side greatly swirls along the first guide part 20. In a first washing water that flows into the first guide part 20 on a front side of the water storage part 14, a first washing water that flows into a front side swirls along the first guide part 20 with a large length, so that a kinetic energy thereof is reduced and flowing into the second guide part 21 and the passing water channel 15 is suppressed. Moreover, landing of a washing water that swirls along the first guide part 20 onto the second guide part 21 is suppressed by the ridge line part 23. That is, recombining of a first washing water that once deviates from a main stream of a first washing water with the main stream of a first washing water is suppressed.

A direction of a flow of a first washing water that deviates from a main stream of a first washing water may greatly be different from that of the main stream of a first washing water, so that, as such a first washing water is combined with the main stream of a first washing water, a force of the main stream of a first washing water may be reduced and an insufficient swirl of the main stream of a first washing water may be caused. It is possible for the first guide part 20 to suppress occurrence of an insufficient swirl of a main stream of a first washing water.

Furthermore, in a first washing water that flows into the first guide part 20 on a front side of the water storage part 14, when a first washing water that flows into a front side swirls and flows down, a kinetic energy thereof increases. In a first washing water that flows into the first guide part 20 on a front side of the water storage part 14, flowing of a first washing water that flows into a front side into the second region 101 is suppressed, so that it swirls along the first guide part 20*b* and flows into the first region 100 from a right side.

A second washing water swirls along the back wall part 22, subsequently flows along the first guide part 20*a* and flows into the second region 101. Furthermore, a second washing water branches immediately after being spouted from the second water spout port 13 or in a middle of swirling along the back wall part 22, and also flows into the first region 100.

As described above, a main stream of a first washing water and a first washing water that deviates from the main stream of a first washing water flow into the first region 100 and a part of a first washing water flows into the second region 101. Furthermore, a second washing water flows into the first region 100 and the second region 101.

A washing water that flows into the first region 100 and the second region 101 forms a first swirling flow in the first region 100 and forms a second swirling flow that is different from the first swirling flow in the second region 101.

Next, a first swirling flow and a second swirling flow will be explained with reference to FIG. 6 and FIG. 7.

For the pair of side surface parts 32 of the water storage part 14, respective convex parts 32*a* are formed as illustrated in FIG. 6. Hence, although a washing water that flows into the water storage part 14 while swirling in the bowl part 10 forms a flow along a wall surface(s) (the front surface part 30, the back surface part 31, and the side surface parts 32) that compose(s) the water storage part 14 in a plan view, a flow that is separated from the wall surface(s) is provided by a convex surface 32*a*, so that a first swirling flow is formed in the first region 100 on a back side of a vertex of the convex surface 32*a* and a second swirling flow is formed in the second region 101 on a front side of the vertex of the convex surface 32*a*.

Additionally, the convex surface 32*a* is formed along upward and downward directions, so that a first swirling flow is formed in a whole of the first region 100 and a second swirling flow is formed in a whole of the second region 101.

In the first region 100, waste is agitated by a first swirling flow. Furthermore, in the second region 101, waste is agitated by a second swirling flow. Thereby, different swirling components that are a first swirling flow and a second swirling flow in a direction of a plan view are generated in the water storage part 14, so that it is possible to improve an agitation performance for waste in a whole of the water storage part 14.

Furthermore, when waste is discharged from the water storage part 14 to the discharge channel 17, waste is pushed into the discharge channel 17 by a first swirling flow and is discharged from the discharge channel 17. Furthermore, when waste is discharged from the water storage part 14 to the discharge channel 17, a second swirling flow flows into the first region 100, waste is pushed into the discharge channel 17 by the second swirling flow and is discharged from the discharge channel 17.

Furthermore, a cross-sectional area of the first region 100 in a horizontal direction is greater than a cross-sectional area of the second region 101 in a horizontal direction.

Thereby, a first swirling flow with a large swirl radius is formed in the first region 100 and a second swirling flow with a swirl radius that is less than that of the first swirling flow is formed in the second region 101. Hence, waste is readily agitated by a small swirling flow in the second region 101, and further, a large swirling flow smoothly flows through the discharge channel 17 in the first region 100, so that waste is readily discharged.

Furthermore, a curvature of a curved surface that forms the first region 100 and a curvature of a curved surface that forms the second region 101 are different. Specifically, a curvature of a curved surface that forms the upper region 100*b* of the first region 100 and a curvature of a curved surface that forms the second region 101 are different.

Thereby, swirling flows with different flow rates are formed in the upper region 100*b* and the second region 101.

Furthermore, in the first region 100, a curvature of a curved surface that forms the upper region 100*b* and a curvature of a curved surface that forms the lower region 100*a* are different. Specifically, a curvature of a curved surface that forms the upper region 100*b* is greater than a curvature of a curved surface that forms the lower region 100*a*.

Thereby, in the upper region 100*b*, a curvature of a curved surface that forms the upper region 100*b* is large, so that a change of a flow rate of a first swirling flow is large and waste is agitated. Furthermore, in the lower region 100*a*, a curvature of a curved surface that forms the lower region 100*a* is small, so that a change of a flow rate of a first swirling flow is small, a flow of the first swirling flow is smooth, and waste is readily discharged to the discharge channel 17. That is, in the first region 100, the upper region 100*b* where a first swirling flow that mainly agitates waste is formed and the lower region 100*a* where a first swirling flow that mainly discharges waste is formed are formed.

Effect

Next, an effect of the flush toilet 1 according to an embodiment will be explained.

The flush toilet 1 includes the bowl part 10, the rim part 11, the first water spout port 12, and the water storage part 14. The bowl part 10 receives waste. The rim part 11 is formed on a top of the bowl part 10. The first water spout port 12 spouts a first washing water. The water storage part 14 is formed on a bottom of the bowl part 10. In the water storage part 14, the first region 100 that is connected to the discharge channel 17 and the second region 101 that is located on a front side of the first region 100 are formed. A main stream of a first washing water that is spouted from the first water spout part 12 along the rim part 11 swirls in the bowl part 10 and flows into the first region 100.

Thereby, the flush toilet 1 causes a main stream of a first washing water that has a strong swirl force to flow into the first region 100, pushes waste into the discharge channel 17 while agitating it in the first region 100, and discharges the waste. Hence, it is possible for the flush toilet 1 to improve a discharging performance for waste.

Furthermore, the flush toilet 1 includes the first water spout port 12 and the second water spout port 13. The first water spout port 12 spouts a first washing water along the rim part 11. The second water spout port 13 is provided at a place that is different from that of the first water spout port 12 and spouts a second washing water. A main stream of a first washing water flows into the first region 100. A second washing water flows into the second region 101.

Thereby, the flush toilet 1 agitates waste by a main stream of a first washing water in the first region 100 and agitates waste by a second washing water in the second region 101. Hence, it is possible for the flush toilet 1 to improve an agitation performance for waste and improve a discharging performance for waste. Furthermore, it is possible for the flush toilet 1 to push waste into the discharge channel 17 and discharge the waste from the discharge channel 17 by a washing water that flows from the second region 101 into the first region 100, when waste is discharged. Hence, it is possible for the flush toilet 1 to improve a discharging performance for waste.

Furthermore, the flush toilet 1 forms a first swirling flow in the first region 100 and forms a second swirling flow that is different from the first swirling flow in the second region 101.

Thereby, the flush toilet 1 forms respective swirling flows in the respective regions 100, 101 and agitates waste by the respective swirling flows. Hence, it is possible for the flush toilet 1 to improve an agitation performance for waste and improve a discharging performance for waste, as compared with, for example, a case where waste is agitated by one strong swirling flow in the water storage part 14. Furthermore, it is possible for the flush toilet 1 to agitate waste by a first swirling flow and a second swirling flow near a boundary between the first region 100 and the second region 101. Hence, it is possible for the flush toilet 1 to improve an agitation performance for waste and improve a discharging performance for waste.

Furthermore, in the flush toilet 1, a part of a first washing water branches from a main stream of a first washing water, is combined with a second washing water, and flows into the second region 101.

Thereby, the flush toilet 1 combines a first washing water and a second washing water and forms a second swirling flow in the second region 101 by a washing water that has a strong force. Hence, it is possible for the flush toilet 1 to increase a force of a second swirling flow in the second region 101, and it is possible to improve an agitation performance for waste in the second region 101 and improve a discharging performance for waste. Furthermore, the flush toilet 1 causes a second swirling flow that has a strong force to flow from the second region 101 into the first region 100 when waste is discharged, so that it is possible to push waste into the discharge channel 17. Hence, it is possible for the flush toilet 1 to improve a discharging performance for waste.

Furthermore, a height of the bottom surface wall 21*a* that forms the passing water channel 15 where a first washing water flows along the rim part 11 increases from an end part on a side of the first water spout port 12 toward a front end of the bowl part 10.

Thereby, the flush toilet 1 reduces a kinetic energy that is possessed by a main stream of a first washing water and suppresses a force of the main stream of a first washing water. That is, the flush toilet 1 adjusts a swirl force of a main stream of a first washing water, so that it is possible to suppress excessive swirling of the main stream of a first washing water. Hence, it is possible for the flush toilet 1 to cause a main stream of a first washing water with an adjusted force to flow into the first region 100 and it is possible to form a first swirling flow with an excellent agitation performance for waste in the first region 100. Therefore, it is possible for the flush toilet 1 to improve a discharging performance for waste.

Furthermore, a height of the bottom surface wall 21*a* continuously increases to a front end of the bowl part 10.

Thereby, it is possible for the flush toilet 1 to reduce a kinetic energy that is possessed by a main stream of a first washing water continuously and it is possible to suppress disturbing of the main stream of a first washing water.

Furthermore, the bowl part 10 includes the first guide part 20*a* where a part of a first washing water branches from the passing water channel 15 and flows thereon.

Thereby, the flush toilet 1 reduces a kinetic energy that is possessed by a main stream of a first washing water, so that it is possible to adjust a swirl force of the main stream of a first washing water. Hence, the flush toilet 1 suppresses excessive swirling of a main stream of a first washing water, so that it is possible to form a first swirling flow with an excellent agitation performance for waste in the first region 100. Therefore, it is possible for the flush toilet 1 to improve a discharging performance for waste.

A slope of the first guide part 20*a* increases from a back side toward a front side.

Thereby, it is possible for the flush toilet 1 to suppress combining of a first washing water that branches from a main stream of a first washing water with the main stream of a first washing water. Furthermore, it is possible for the flush toilet 1 to cause a first washing water that branches from a main stream of a first washing water to flow into the second region 101.

Furthermore, a length from an upper end of the water storage part 14 to an upper end of the first guide part 20*a* increases toward a front side of the bowl part 10.

Thereby, the flush toilet 1 disperses a first washing water that deviates from a main stream of a first washing water in the first guide part 20 on a front side of the water storage part 14, so that it is possible to reduce a kinetic energy that is possessed by a first washing water that flows through the first guide part 20. Hence, it is possible for the flush toilet 1 to suppress combining of a first washing water that flows through the first guide part 20 on a front side of the water storage part 14 with a main stream of a first washing water, and it is possible to form a first swirling flow with an excellent agitation performance for waste in the first region 100. Therefore, it is possible for the flush toilet 1 to improve a discharging performance for waste.

Furthermore, a height of an upper end of the water storage part 14 is minimum at a front end thereof.

Thereby, it is possible for the flush toilet 1 to increase a length of the first guide part 20 at a center in leftward and rightward directions in the first guide part 20 on a front side of the water storage part 14, and it is possible to reduce a kinetic energy that is possessed by a first washing water that flows through the first guide part 20. Hence, it is possible for the flush toilet 1 to suppress combining of a first washing water that flows through the first guide part 20 on a front side of the water storage part 14 with a main stream of a first washing water, and it is possible to form a first swirling flow with an excellent agitation performance for waste in the first region 100. Therefore, it is possible for the flush toilet 1 to improve a discharging performance for waste.

Furthermore, the flush toilet 1 includes the region extension part 21*b* that extends a water spout region for a first washing water that is spouted from the first water spout port 12.

Thereby, the flush toilet 1 suppresses decreasing of a water spout region of the passing water channel 15 for a first washing water, even in a case where the bottom surface wall 21*a* that forms the passing water channel 15 is formed so as to heighten from a side of the first water spout port 12 toward a front end of the rim part 11. Hence, the flush toilet 1 suppresses retaining of a first washing water on the passing water channel 15, so that it is possible to spout a first washing water smoothly.

Therefore, it is possible for the flush toilet 1 to suppress insufficient swirling of a main stream of a first washing water and it is possible to improve a discharging performance for waste.

Furthermore, the region extension part 21*b* is formed below the first water spout port 12.

Thereby, the flush toilet 1 suppresses occurrence of unexpected retention on the passing water channel 15 where a first washing water flows, so that it is possible to suppress insufficient swirling of a main stream of a first washing water. Hence, it is possible for the flush toilet 1 to improve a discharging performance for waste.

Furthermore, the region extension part 21*b* is formed on an end part of the bottom surface wall 21*a* on a side of the first water spout port 12.

Thereby, it is possible for the flush toilet 1 to suppress retaining of a first washing water immediately after being spouted from the first water spout port 12.

The region extension part 21*b* is sloped in such a manner that a side of the bowl part 10 is lower than a side of the rim part 11.

Thereby, it is possible for the flush toilet 1 to cause a part of a first washing water that flows into the region extension part 21*b* to flow down to the first guide part 20 quickly and it is possible to suppress retaining of a first washing water on the region extension part 21*b*. Hence, it is possible for the flush toilet 1 to suppress insufficient swirling of a main stream of a first washing water. Therefore, it is possible for the flush toilet 1 to improve a discharging performance for waste.

Furthermore, the bowl part 10 includes the first guide part 20*b* that causes a first washing water to swirl from a left side to a right side and causes a first washing water that swirls to a right side to flow into the first region 100.

Thereby, it is possible for the flush toilet 1 to cause a first washing water that deviates from a main stream of a first washing water to flow into the first region 100 and it is possible to increase a force of a first swirling flow in the first region 100. Hence, it is possible for the flush toilet 1 to improve a discharging performance for waste.

Furthermore, the first guide part 20 is formed so as to broaden from a front side toward a back side.

Thereby, it is possible for the flush toilet 1 to cause a first washing water that deviates from a main stream of a first washing water and flows into a vicinity of a center of the first guide part 20 in leftward and rightward directions to flow into the first region while swirling along the first guide part 20. Hence, it is possible for the flush toilet 1 to increase a force of a first swirling flow in the first region 100 and it is possible to improve a discharging performance for waste.

Furthermore, the bowl part 10 includes the second guide part 21 that is formed above the first guide part 23. A first washing water that flows through the second guide part 21 is a flow that is different from a first washing water that flows through the first guide part 20. A distance of the ridge line part 23 that connects the first guide part 20 and the second guide part 21 from the center line O of the bowl part 10 in leftward and rightward directions increases from a front side toward a back side.

Thereby, it is possible for the flush toilet 1 to suppress flowing of a first washing water that flows through the first guide part 20 into the second guide part 21. That is, it is possible for the flush toilet 1 to suppress combining of a washing water that deviates from a main stream of a first washing water with the main stream of a first washing water. Hence, the flush toilet 1 suppresses disturbing of a main stream of a first washing water, so that it is possible to suppress reducing of a flow rate of the main stream of a first washing water. Therefore, it is possible for the flush toilet 1 to improve a discharging performance for waste by a first swirl force.

The ridge line part 23 on a right side terminates on a back side of a middle point of the water storage part 14 in frontward and backward directions.

Thereby, it is possible for the flush toilet 1 to cause a first washing water that swirls to a back side to flow into the first region 100. Furthermore, it is possible for the flush toilet 1 to generate, in the first region 100, a first swirling flow along a shape of the back surface part 31 of the water storage part 14 that forms the first region 100. Hence, it is possible for the flush toilet 1 to agitate waste by a first swirling flow with a strong force, and it is possible to improve an agitation performance for waste in the first region 100 and improve a discharging performance for waste.

Furthermore, the first guide part 20 on a front side of the water storage part 14 is provided in such a manner that a curvature of a curved surface that forms the first guide part 20 increases from a front side toward a back side.

Thereby, the flush toilet 1 rapidly changes a direction of a first washing water that flows into a place that is close to the water storage part 14, in the first guide part 20 on a front side of the water storage part 14, so that it is possible to suppress flowing of a first washing water into the second region 101. Then, it is possible for the flush toilet 1 to cause a first washing water to swirl to a right side and flow into the first region 100. Furthermore, the flush toilet 1 suppresses rapid changing of a direction of a first washing water that flows into a front side of the bowl part 10, in the first guide part 20 on a front side of the water storage part 14. Hence, the flush toilet 1 suppresses flowing of a first washing water into the second region 101, so that it is possible to cause a first washing water to swirl to a right side and flow into the first region 100.

Furthermore, the water storage part 14 includes the front surface part 30, the back surface part 31, and the pair of side surface parts 32. The back surface part 31 is formed on a back side of the front surface part 30. The pair of side surface parts 32 is formed between the front surface part 30 and the back surface part 31. In the pair of side surface parts 32, on at least one side surface part 32, the convex surface 32*a* that protrudes toward another side surface part 32 is formed.

A washing water that flows into the water storage part 14 flows along the side surface part 32, so that swirling is separated by the convex surface 32*a* of the side surface part 32. Thereby, the flush toilet 1 forms a first swirling flow and a second swirling flow in the water storage part 14. Hence, it is possible for the flush toilet 1 to agitate waste by each swirling flow, and it is possible to improve an agitation performance for waste and improve a discharging performance for waste.

Furthermore, in the water storage part 14, the first region 100 that is connected to the discharge channel 17 and the second region 101 that is located on a front side of the first region 100 are formed, and the convex surface 32*a* is formed over the first region 100 to the second region 101.

Thereby, it is possible for the flush toilet 1 to generate a first swirling flow and a second swirling flow in the water storage part 14 without complicating a shape of the water storage part 14.

Furthermore, a vertex of the convex surface 32*a* is located at a boundary between the first region 100 and the second region 101.

Thereby, it is possible for the flush toilet 1 to execute partition into the first region 100 that is connected to the discharge channel 17 and the second region 101 by the convex surface 32*a* and it is possible to form a first swirling flow and a second swirling flow independently. Hence, it is possible for the flush toilet 1 to agitate waste by each swirling flow, and it is possible to improve an agitation performance for waste and improve a discharging performance for waste.

Furthermore, the convex surface 32*a* is formed along upward and downward directions.

Thereby, it is possible for the flush toilet 1 to form a first swirling flow in a whole of the first region 100 and form a second swirling flow in a whole of the second region 101. Hence, it is possible for the flush toilet 1 to improve an agitation performance for waste in the respective regions 100, 101 and improve a discharging performance for waste.

Furthermore, a surface area of the first region 100 in a horizontal direction is greater than a surface area of the second region 101 in a horizontal direction.

Thereby, the flush toilet 1 agitates waste by a second swirling flow that has a small swirl radius in the second region 101. Furthermore, the flush toilet 1 generates a first swirling flow that has a large swirl radius in the first region 100 that is connected to the discharge channel 17, and discharges waste from the first region 100 by the first swirling flow. Hence, it is possible for the flush toilet 1 to improve an agitation performance for waste and improve a discharging performance for waste.

Furthermore, the convex surface 32*a* is respectively formed on the pair of side surface parts 32.

Thereby, it is possible for the flush toilet 1 to accelerate formation of a first swirling flow in the first region 100 and accelerate formation of a second swirling flow in the second region 101. Hence, it is possible for the flush toilet 1 to improve an agitation performance for waste and improve a discharging performance for waste.

Furthermore, a curved surface of the water storage part 14 that forms the first region 100 is provided in such a manner that a curvature of the curved surface is different in upward and downward directions.

Thereby, it is possible for the flush toilet 1 to form a first swirling flow that mainly agitates waste and a first swirling flow that mainly pushes waste into the discharge channel 17 and discharges the waste, in upward and downward directions of the first region 100. Hence, it is possible for the flush toilet 1 to improve an agitation performance for waste and improve a discharging performance for waste.

Furthermore, in the first region 100, the upper region 100*b* and the lower region 100*a* that is formed below the upper region 100*b* are formed. A curvature of a curved surface that forms the upper region 100*b* is greater than a curvature of a curved surface that forms the lower region 100*a*.

Thereby, the flush toilet 1 forms a first swirling flow with a large change of a flow rate in the upper region 100*b*, so that it is possible to agitate waste. Furthermore, the flush toilet 1 forms a first swirling flow with a small change of a flow rate in the lower region 100*a*, so that it is possible to push waste into the discharge channel 17 and discharge the waste.

Furthermore, a curvature of a curved surface that forms the first region 100 gradually changes from the upper region 100*b* toward the lower region 100*a*.

Thereby, it is possible for the flush toilet 1 to reduce an energy loss at a time when a change is executed from a first swirling flow with a large change of a flow rate to a first swirling flow with a small change of a flow rate, and it is possible to improve a discharging performance for waste.

Furthermore, a curvature of a curved surface that forms the upper region 100*b* is different from a curvature of a curved surface that forms the second region 101.

Thereby, it is possible for the flush toilet 1 to cause a first swirling flow in the upper region 100*b* and a second swirling flow in the second region 101 to swirl at different flow rates. Hence, it is possible for the flush toilet 1 to improve an agitation performance for waste and improve a discharging performance for waste.

Furthermore, a curvature of a curved surface that forms the lower region 100*a* is less than a curvature of a curved surface that forms the second region 101.

Thereby, it is possible for the flush toilet 1 to guide a second swirling flow from the second region 101 to the lower region 100*a* smoothly and it is possible to improve a discharging performance for waste.

Variation Example(s)

A flush toilet 1 according to a variation example may connect the discharge channel 17 to a region on a front side of the water storage part 14. Furthermore, a flush toilet 1 according to a variation example may form the convex surface 32*a* on one side surface part 32 in the pair of side surface parts 32.

Furthermore, a flush toilet 1 according to a variation example may form the first water spout port 12 into a taper shape in such a manner that a first washing water is broadened, and extend a water spout region for a first washing water from the first water spout pore 12. For example, the first water spout port 12 is formed so as to extend a water spout region for a first washing water on a upper side or a right side.

Furthermore, a flush toilet 1 according to a variation example may be a flush toilet that includes a part of a configuration as described above. For example, a flush toilet 1 according to a variation example may be a flush toilet that has the water storage part 14 where the convex surface 32*a* is not formed on the pair of side surface parts 32 or may be a flush toilet that has the bowl part 10 where the first guide part 20 is not formed. Furthermore, for example, a flush toilet 1 according to a variation example may be a flush toilet that has only the first water spout port 12.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A flush toilet, comprising:

a bowl part that receives waste;

a rim part that is formed on a top of the bowl part;

a water spout port that spouts a washing water; and a water storage part that is formed on a bottom of the bowl part, wherein a first region that is connected to a discharge channel and a second region that is located on a front side of the first region are formed in the water storage part, and a main stream of a washing water that is spouted from the water spout port along the rim part swirls on the bowl part and flows into the first region, wherein the water spout port comprises a first water spout port that spouts a washing water along the rim part, and a height of a bottom surface wall that forms a passing water channel where a washing water that is spouted from the first water spout port flows along the rim part increases from an end part on a side of the first water spout port toward a front end of the bowl part.

2. The flush toilet according to claim 1, wherein the water spout port further comprises:

a second water spout port that is provided at a place that is different from that of the first water spout port and spouts a washing water, wherein a main stream of a washing water that is spouted from the first water spout port flows into the first region, and a washing water that is spouted from the second water spout port flows into the second region.

3. The flush toilet according to claim 2, wherein a first swirling flow is formed in the first region, and a second swirling flow that is different from the first swirling flow is formed in the second region.

4. The flush toilet according to claim 2, wherein a part of a washing water that is spouted from the first water spout port branches from a main stream thereof, is combined with a washing water that is spouted from the second water spout port, and flows into the second region.

* * * * *